US009123480B2

(12) United States Patent
Einschenk et al.

(10) Patent No.: US 9,123,480 B2
(45) Date of Patent: Sep. 1, 2015

(54) DRIVE FOR A SWITCHING DEVICE

(75) Inventors: Jürgen Einschenk, Panketal (DE); Karsten Freundt, Falkensee (DE); Unni Suresh, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/131,033

(22) PCT Filed: Jun. 14, 2012

(86) PCT No.: PCT/EP2012/061340

§ 371 (c)(1),
(2), (4) Date: Feb. 21, 2014

(87) PCT Pub. No.: WO2013/004467

PCT Pub. Date: Jan. 10, 2013

(65) Prior Publication Data

US 2014/0167889 A1 Jun. 19, 2014

(51) Int. Cl.

| | |
|---|---|
| ***H01H 9/20*** | (2006.01) |
| ***H01H 3/28*** | (2006.01) |
| ***H01H 3/42*** | (2006.01) |
| ***H01H 3/52*** | (2006.01) |
| ***H01H 3/02*** | (2006.01) |
| *H01H 33/666* | (2006.01) |

(52) U.S. Cl.

CPC . *H01H 9/20* (2013.01); *H01H 3/02* (2013.01); *H01H 3/28* (2013.01); *H01H 3/42* (2013.01); *H01H 3/52* (2013.01); *H01H 33/6662* (2013.01)

(58) Field of Classification Search

CPC ..... H01H 50/005; H01H 51/00; H01H 2001/0078; H01H 49/00; H01H 2050/007; Y10T 29/4902

USPC ..... 335/167–174; 218/118, 141

See application file for complete search history.

(56) References Cited

U.S. PATENT DOCUMENTS

| | | | | |
|---|---|---|---|---|
| 3,209,101 | A * | 9/1965 | Peek et al. | 335/166 |
| 3,471,814 | A | 10/1969 | Burdett | |
| 3,794,798 | A * | 2/1974 | Trayer | 335/151 |
| 4,234,771 | A | 11/1980 | Ohkawa et al. | |
| 4,336,520 | A * | 6/1982 | Trayer | 337/191 |

FOREIGN PATENT DOCUMENTS

| | | | |
|---|---|---|---|
| DE | 6949596 | U | 1/1973 |
| DE | 2754547 | B2 | 12/1980 |
| WO | 2004109734 | A1 | 12/2004 |
| WO | 2010026048 | A1 | 3/2010 |

* cited by examiner

*Primary Examiner* — Bernard Rojas

(74) *Attorney, Agent, or Firm* — Laurence A. Greenberg; Werner H. Stemer; Ralph E. Locher

(57) ABSTRACT

A drive for a switching device having a contact system with a fixed contact and a moving contact, includes a force initiation element for initiating a drive force, an actuator for actuating the moving contact to close or open the contact system and a transmission disposed between the force initiation element and the actuator. The transmission allows both transferring the contact system from the closed to the open state and transferring the contact system from the open to the closed state to be triggered by a drive force in the same direction, making the drive cost-effective and compact.

2 Claims, 3 Drawing Sheets

DRIVE FOR A SWITCHING DEVICE

BACKGROUND OF THE INVENTION

Field of the Invention

The invention relates to a drive for a switching device, which has a contact system made up of a fixed contact and a moving contact, having a force initiation element for initiating a drive force and an actuator for actuating the moving contact to close or open the contact system as well as transmission means disposed between the force initiation element and the actuator.

Such a drive is known from the generally accepted prior art and has as its force initiation element for example a spring storage system and as its actuator a drive rod coupled to the moving contact, a mechanical rocker system with a rotatably supported rocker being provided as the transmission means, the rocker transmitting the drive force of the force initiation element to the drive rod to open or close the contact system of the switching device.

BRIEF SUMMARY OF THE INVENTION

It is the object of the present invention to develop a drive of the type mentioned in the introduction, which is economical and compact in structure.

According to the invention this is achieved with a drive of the type mentioned in the introduction in that the transmission means are configured in such a manner that both the transferring of the contact system from the closed to the open state and the transferring of the contact system from the open to the closed state can be triggered by a drive force in the same direction.

Such a drive is both economical and compact because with transmission means configured in this manner, with which the transferring of the compact system from the closed state to the open state and the transferring of the contact system from the open to the closed state can be triggered by a drive force in the same direction, complex mechanisms for reversing movement can simply be avoided.

In one advantageous embodiment of the invention the transmission means have a rotatable rod which has a staged profile on its end facing the actuator for transmitting force to the actuator. Such a staged profile on a rotatable rod for transmitting force to the actuator to actuate the moving contact of the switching device is particularly advantageous because by initiating the drive force of the force initiation element and executing a rotation of the rotatable rod, the actuator can be transferred both by the staged profile from a lower first level of the staged profile with the contact system of the switching device open along an incline by way of a latching stage to an upper second level of the staged profile with the contact system of the switching device closed, and can also be transferred from the upper second level and closed contact system by way of a latching stage to the lower first level of the staged profile to open the contact system with the initiated drive force in the same direction.

The force initiation element here can be configured in different ways. It is particularly preferable for a solenoid drive coupled to a deactivation spring to be provided as the force initiation element, said solenoid drive being provided to initiate a drive force in the transmission means in just one direction, with the force of the solenoid drive bringing about the transferring of the staged profile of the rotatable rod from its lower to its upper level to activate or close the contact system of the switching device and during deactivation the force in the same direction of the solenoid drive causing the staged profile to be transferred from the upper to the lower level in conjunction with the deactivation spring.

BRIEF DESCRIPTION OF THE SEVERAAL VIEWS OF THE DRAWING

The invention is described in more detail below based on the drawing and an exemplary embodiment with reference to the accompanying figures, in which.

DESCRIPTION OF THE INVENTION

Figure 1:
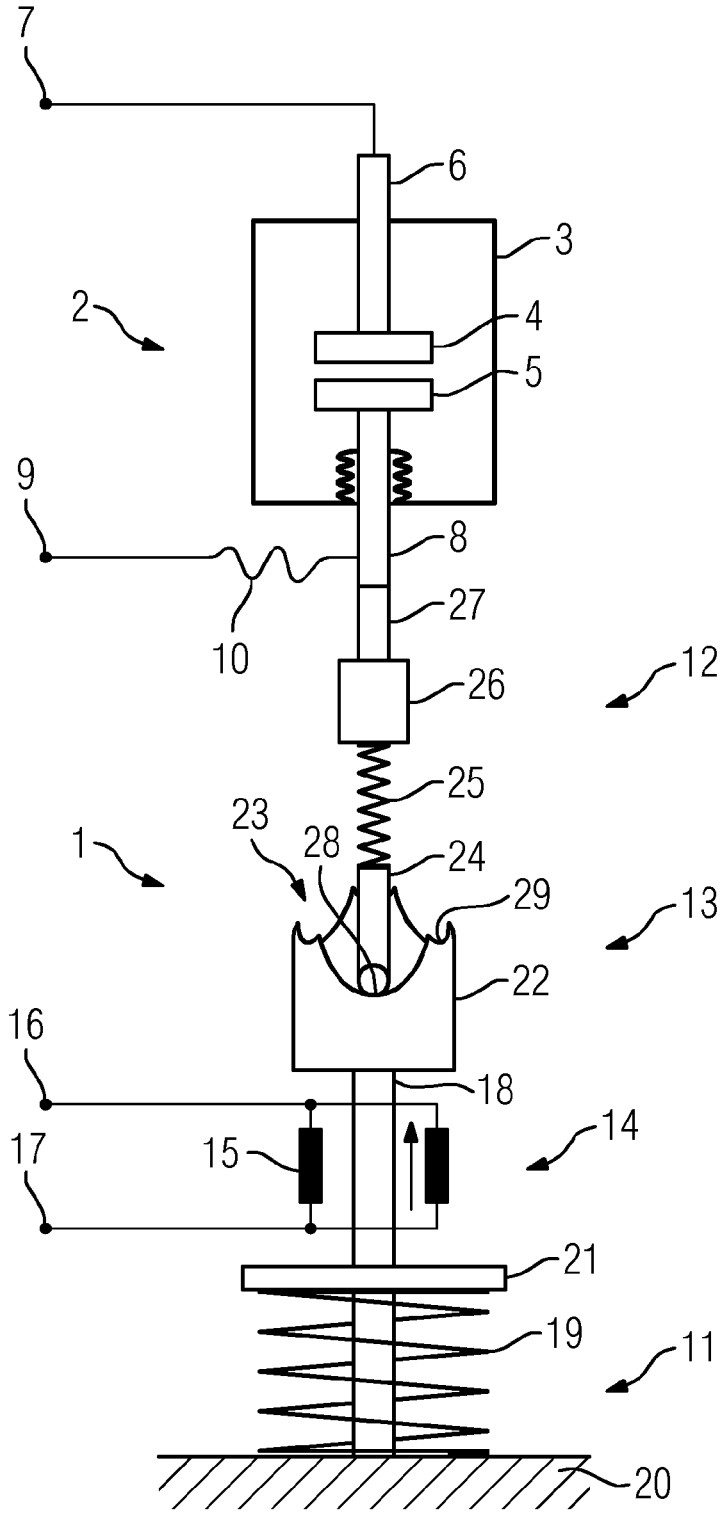
FIG. 1 shows an exemplary embodiment of an inventive drive with a switching device in a first position.

FIG. 1 shows a drive 1 for a switching device 2, for example in the form of a vacuum switching tube, having a contact system 3 made up of a fixed contact 4 and a moving contact 5. The fixed contact 4 is connected in an electrically conducting manner by way of a fixed contact connector pin 6 to a first connector 7 of the switching device 2, the moving contact 5 is connected in an electrically conducting manner by way of a moving contact connector pin 8 to a second connector 9 of the switching device 2, with an electrically conducting flexible segment 10 being provided between the moving contact connector pin 8 and the second connector 9, so that movement of the moving contact connector pin 8 is permitted while maintaining the electrical connection to the second connector 9. FIG. 1 shows the contact system 3 in its opened state, in other words there is no conducting connection between the fixed contact 4 and the moving contact 5.

The drive 1 comprises a force initiation element 11 and an actuator 12, as well as transmission means 13 disposed therebetween. The force initiation element 11 serves to initiate a drive force to close or open the contact system 3 of the switching device 2 and in the exemplary embodiment has an electromagnet 14 with a coil 15, said coil 15 being connected by way of connectors 16 and 17 to a voltage source (not shown in the figure) to energize the coil 15. An armature 18 of the electromagnet 14 here is configured in such a manner that when the coil 15 is energized, the armature 18 is subject to a drive force upward in the direction of the arrow in FIG. 1. The force induction element 11 also comprises a deactivation spring 19, which is fastened to a first bearing 20, for example a housing segment of the switching device 2, and is fastened at its second end to a counter bearing 21 fastened to the armature 18, the deactivation spring 19 being shown in its relaxed state in FIG. 1. The transmission means 13 comprise a rod 22, which is supported in such a manner that it can be rotated in relation to the armature 18, said rod 22 having a staged profile 23 on its end facing the actuator 12, which is described in more detail with reference to FIGS. 3 and 4.

The actuator 12 comprises an actuation rod 24, which is configured by the staged profile 23 of the rotatably supported rod 22, also a contact pressure spring 25 for applying a contact pressure force when the contact system 3 of the switching device 2 is in the closed state, as well as an isolating segment 26 for the electrical isolation of drive 1 in relation to switching device 2 and a coupling segment 27 for the mechanical coupling of the actuator 12 to the moving contact connector pin 8.

Figure 2:
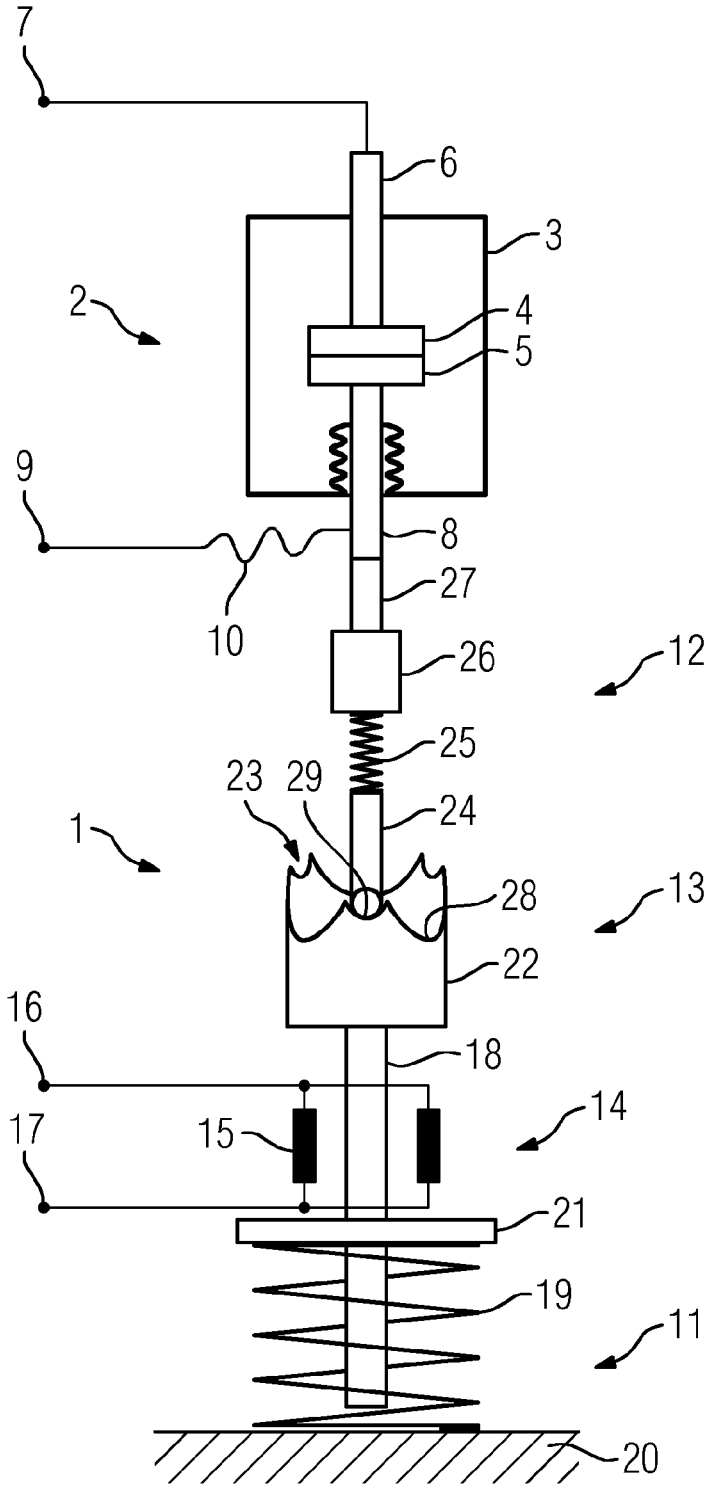
FIG. 2 shows the exemplary embodiment of the inventive drive from FIG. 1 with a switching device in a second position.

To transfer the contact system 3 of the switching device 2 from the opened state illustrated in FIG. 1, a drive force is now initiated by the force initiation element 11, in that the energization of the coil 15 and the generation of a corresponding magnetic field cause the armature 18 of the electromagnet 14 to be subject to a force upward in the direction of the arrow, as a result of which the rotatably supported rod 22 is caused to rotate in the direction of the rotary arrow, with the staged profile 23 of the rotatably supported rod 22 transferring the actuation rod 24 from the lower level 28 to the upper level 29, thereby tensioning the contact pressure spring 25 and causing the moving contact connector pin 8 to be subject to an upward movement in the exemplary embodiment, so that the contact system 3 made up of the fixed contact 4 and moving contact 5 is transferred to the closed state, as illustrated in FIG. 2, in which the actuation rod 24 is in the upper level 29 of the staged profile 23 of the rotatably supported rod 22 and the contact pressure spring 25 is tensioned. The deactivation spring 19 is tensioned at the same time in this process.

To reverse this process, starting from the state in FIG. 2 the coil 15 is once again energized to initiate a force in the armature 18 of the electromagnet 14 upward in the direction of the arrow, so that rotation of the rotatable rod 22 in the direction of the rotary arrow lifts the actuation rod 24 from the latch in the upper level 29 and further rotation of the rotatable rod 22 causes it to move back into the lower level 28 of the staged profile 23, the energy from the deactivation spring 19 that is tensioned in FIG. 2 being expended, causing the opening of the contact system 3 made up of the moving contact 5 and fixed contact 4 of the switching device 2.

In other words it is possible with the drive 1 to trigger both the transferring of the contact system 3 from the open to the closed state and also the transferring of the contact system 3 from the closed to the open state by a drive force of the electromagnet 14 that is always in the same direction, in the exemplary embodiment upward.

Figure 3:
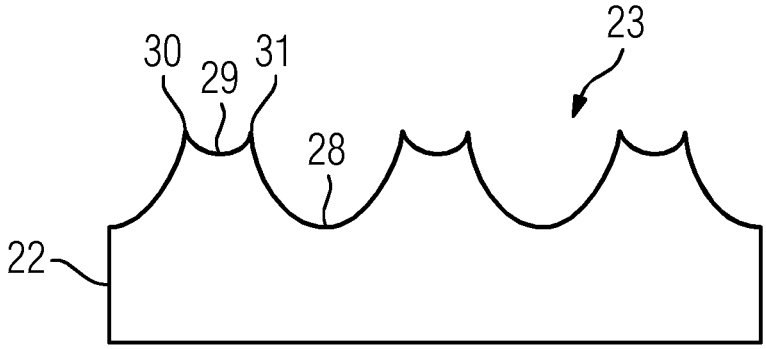
FIG. 3 shows an exemplary embodiment of a staged profile.

FIG. 3 shows a detailed diagram of the staged profile 23 of the rotatable rod 22 from FIGS. 1 and 2 as an opened out lateral surface of the rotatable rod 22 with the lower level 28 and the upper level 29, the transition between lower and upper level being configured as an incline, as well as latching stages 30 and 31 that can be identified in FIG. 3 and allow the latching of the switching device 2 when the contact system 3 is in the closed state.

Figure 4:
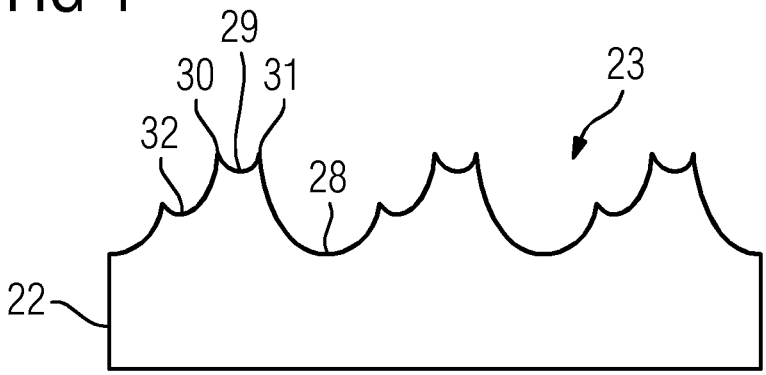
FIG. 4 shows a further exemplary embodiment of a staged profile of the inventive drive.

FIG. 4 shows a further opened out lateral surface of the rotatable rod 22 in a further exemplary embodiment, with an intermediate level 32 being provided in addition to the lower level 28 and the upper level 29, both the intermediate level 32 and the upper level 29 having corresponding latching stages and the transitions being embodied as inclines, so that a three position switch can be also be realized with the staged profile in FIG. 4, for example to realize the functions of closed contact system, opened contact system and isolating position with a large gap between fixed contact and moving contact of the switching device.

LIST OF REFERENCE CHARACTERS

1 Drive
2 Switching device
3 Contact system
4 Fixed contact
5 Moving contact
6 Fixed contact connector pin
7 First connector
8 Moving contact connector pin
9 Second connector
10 Flexible segment
11 Force initiation element
12 Actuator
13 Transmission means
14 Electromagnet
15 Coil
16, 17 Connectors
18 Armature
19 Deactivation spring
20 First bearing
21 Counter bearing
22 Rotatably supported rod
23 Staged profile
24 Actuation rod
25 Contact pressure spring
26 Isolating segment
27 Coupling segment
28 Lower level
29 Upper level
30 Latching stage
31 Latching stage
32 Intermediate level

The invention claimed is:

1. A drive for a switching device including a contact system having a fixed contact, a moving contact, a closed state and an open state, the drive comprising:

a force initiation element configured to initiate a drive force in one direction;

an actuator configured to actuate the moving contact into the closed state and the open state of the contact system; and a transmission disposed between said force initiation element and said actuator, said transmission configured to trigger a transfer of the contact system from the closed state to the open state and a transfer of the contact system from the open state to the closed state, using said drive force in said one direction, said transmission including a rotatably supported rod extended along said one direction and having an end facing said actuator with a staged or stepped profile at said end configured to transmit force to said actuator.

2. The drive according to claim 1, wherein:

said staged or stepped profile of said rotatable rod has a lower level and an upper level;

said force initiation element includes a deactivation spring and a solenoid drive coupled to said deactivation spring;

said solenoid drive configured to initiate a drive force in said transmission in only one direction bringing about a transfer of said staged or stepped profile:

from said lower level to said upper level to activate or close the contact system, and from said upper level to said lower level to deactivate or open the contact system in conjunction with said deactivation spring.

* * * * *